US008881910B2

(12) United States Patent
Guptail et al.

(10) Patent No.: US 8,881,910 B2
(45) Date of Patent: Nov. 11, 2014

(54) SORTING SYSTEM AND METHOD

(75) Inventors: William G. Guptail, Huntley, IL (US); Richard H. Reeves, Palatine, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 13/369,560

(22) Filed: Feb. 9, 2012

(65) Prior Publication Data

US 2012/0261314 A1 Oct. 18, 2012

Related U.S. Application Data

(60) Provisional application No. 61/476,086, filed on Apr. 15, 2011.

(51) Int. Cl.
*B07C 5/00* (2006.01)
*B07B 13/16* (2006.01)
*B07B 4/02* (2006.01)

(52) U.S. Cl.
CPC .. *B07B 4/02* (2013.01); *B07B 13/16* (2013.01)
USPC ..... 209/44.2; 209/143; 209/467

(58) Field of Classification Search
CPC ..... B03B 4/00; B03B 4/005; B03B 4/02; B07B 4/02
USPC ..... 209/44.2, 143, 467
See application file for complete search history.

(56) References Cited

U.S. PATENT DOCUMENTS

| | | | | |
|---|---|---|---|---|
| 3,863,766 | A * | 2/1975 | Oetiker | 209/469 |
| 4,624,370 | A | 11/1986 | Danner et al. | |
| 4,715,950 | A | 12/1987 | Danner et al. | |
| 4,755,284 | A * | 7/1988 | Brooks et al. | 209/20 |
| 4,844,235 | A | 7/1989 | Sherman | |
| 5,024,334 | A * | 6/1991 | Misra et al. | 209/557 |
| 5,301,811 | A * | 4/1994 | Mueller | 209/44.2 |
| 5,984,105 | A | 11/1999 | Lease et al. | |
| 7,422,114 | B2 | 9/2008 | Guptail | |
| 2009/0178958 | A1 | 7/2009 | Guptail et al. | |
| 2010/0177591 | A1 | 7/2010 | Guptail et al. | |

* cited by examiner

*Primary Examiner* — Jeremy R Severson
(74) *Attorney, Agent, or Firm* — Marshall, Gerstein & Borun LLP

(57) ABSTRACT

A system for sorting has an inlet end, a first separation section disposed downstream of the inlet end and including a fluidizing section and a hood disposed above the fluidizing section, a negative pressure developed adjacent the fluidizing section to draw a first class of materials into the hood, a second separation section disposed downstream of the first separation section and including an air knife and a dropout, a second class of materials passing through the air knife and into the dropout and a third class of materials passing over the dropout and through an outlet end, and a vibration generator coupled to the first separation section and the second separation section to convey material from the inlet end to the outlet end.

10 Claims, 12 Drawing Sheets

SORTING SYSTEM AND METHOD

The present application claims benefit of U.S. Provisional Application No. 61/476,086, filed on Apr. 15, 2011, the disclosure of which is hereby incorporated by reference in its entirety.

BACKGROUND

This patent is directed to systems and methods for sorting solid materials, and, in particular, to vibratory systems and methods for sorting solid materials additionally utilizing air streams.

Solid waste may include a variety of materials. For example, there may be lighter-weight materials, such as paper and newsprint. Solid waste may also include heavier-weight materials, such as metal, plastic and glass containers. Also, there may be organic materials, such as vegetation and the like.

It will be recognized that while certain materials may be recycled, other materials may not be recyclable. For example, the paper and newsprint may be recycled, as well as the metal, plastic and glass containers. On the other hand, the organic materials generally are not recyclable, although they may be composted for future reuse.

SUMMARY

According to an aspect of the present disclosure, a system for sorting has an inlet end, a first separation section disposed downstream of the inlet end and including a fluidizing section and a hood disposed above the fluidizing section, a negative pressure developed adjacent the fluidizing section to draw a first class of materials into the hood, a second separation section disposed downstream of the first separation section and including an air knife and a dropout, a second class of materials passing through the air knife and into the dropout and a third class of materials passing over the dropout and through an outlet end, and a vibration generator coupled to the first separation section and the second separation section to convey material from the inlet end to the outlet end.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
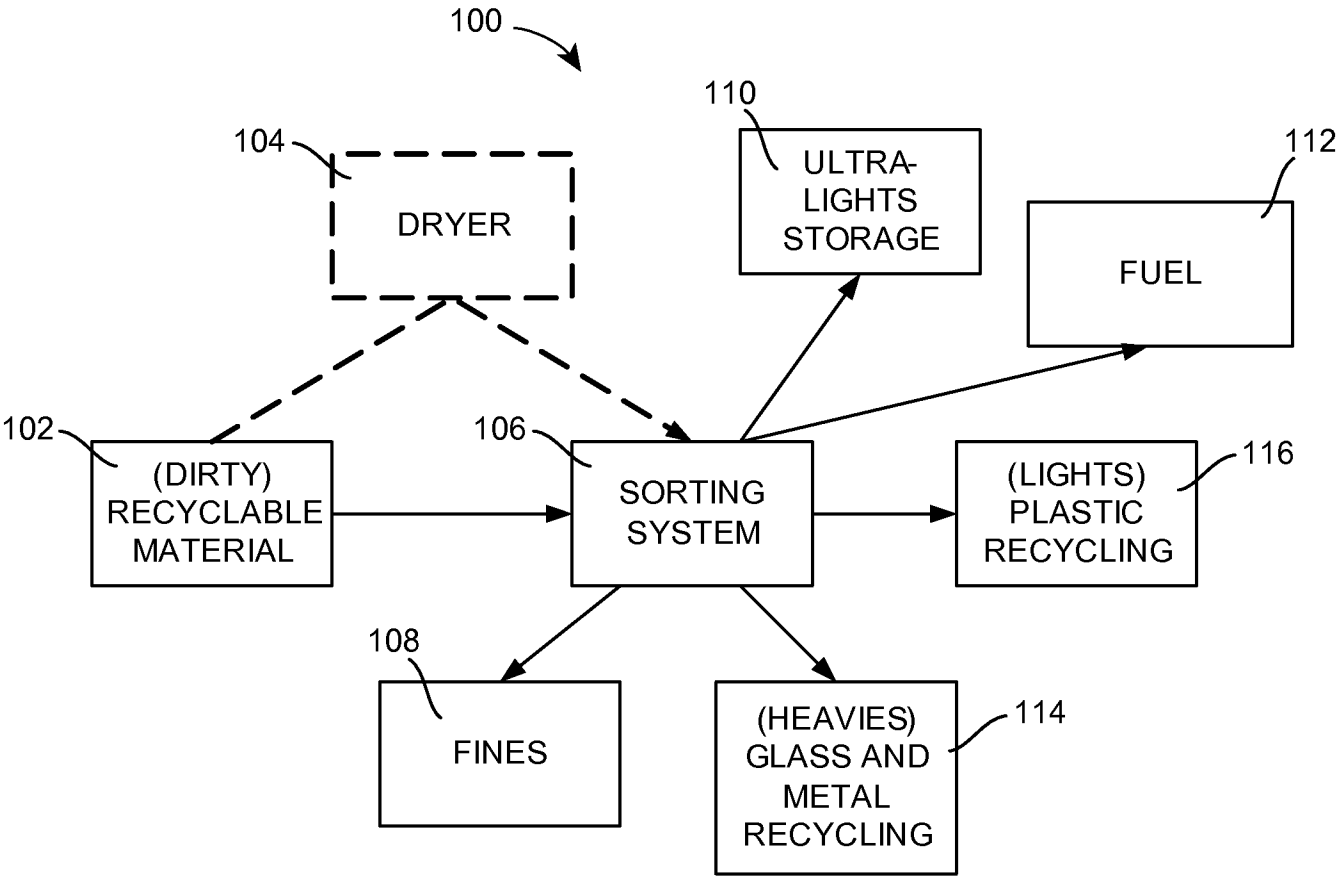
FIG. 1 is a schematic view of a system for sorting solid waste according to the present disclosure.

FIG. 1 illustrates a system for processing solid waste according to the present disclosure. According to the system 100, a source 102 of solid waste, such as (potentially dirty) recyclable material, is established, for example at a central collection point such as a municipal or private dumping ground. The source 102 may be contained to limit or prevent the solid waste from leaving the site, and rodents, insects and other pests from entering the site.

The solid waste source 102 may optionally be coupled to a dryer 104. However, according to the present disclosure, the dryer 104 is not required, because a sorting device according to the present disclosure is used that is capable of handling a higher moisture content than is typically found to be acceptable. As such, it is expected that the source 102 will be coupled to a sorting system 106 according to the present disclosure, rather than to a dryer. However, it may also be the case that the solid waste source 102 may be significantly wetter than is usually capable of being sorting, and the dryer 104 is used to reduce its moisture content, although the moisture content may still exceed that typically present in solid waste that is sorted for recycling purposes.

The sorting system 106, as described below in greater detail, includes a deck on which a bed of solid waste is formed. The solid waste is transported along the deck by coupling a vibration generator to the deck. According to a preferred embodiment, the vibration generator is part of a two-mass system, as it is believed that such a generator will provide a relatively thin bed on the deck. As such, the vibratory apparatus thus defined may be described as a feeder unit.

The sorting system 106 uses an air stream to sort the lighter-weight materials, such as the paper materials, from the heavier-weight materials, such as the plastic, glass and metal containers. In fact, the sorting system may use multiple air streams to sort out paper materials (or ultralights) from the plastic, glass and metal containers, and to sort out the plastic containers (or lights) from the glass and metal containers (or heavies). As such, the sorting system 106 may include one outlet for the paper materials, another outlet for the glass and metal containers, and a further outlet for the plastic materials. According to certain embodiments, fine materials such as stones, dirt, loose vegetation, etc. may be sorted out from the paper materials and the plastic, glass and metal containers upstream of the multiple air streams. According to such an embodiment, there may be separate outlets for the fine materials, the paper materials, the glass and metal containers, and the plastic containers.

In fact, according to one embodiment of the present disclosure, the fine materials may be separated from the other materials through the use of a vibrating screen section, over which the materials received at the input of the system pass during operation of the system. Fine materials exit the system through a first outlet, and may be collected for disposal or storage at 108. The materials may then pass over a fluidizer or fluidizing section that may be combined with a device or system that creates a negative pressure adjacent the fluidizing section. The lighter-weight paper materials passing over the fluidizing section may be removed via the device or system creating the adjacent region of negative pressure, and directed to a separator system or device, which detrains the lighter-weight material from the air stream, whereupon the lighter-weight material may be directed to a storage site 110 for future transport and/or disposal or may be used as fuel 112, such as in an incinerator. The heavier-weight plastic, glass, and metal containers passing may then pass over an adjustable air stream, which may be in the form of an air knife, that separates the plastic containers from the glass and metal containers. The glass and metal containers may pass through a third outlet (or dropout) and be directed to a first section 114 of a recycling plant, to storage, or for further transport, while the plastic containers may pass over the air knife to a fourth outlet, where the plastic containers are directed to a second section 116 of the recycling plant, to storage, or for further transport.

Having thus described the system 100 in general detail with reference to FIG. 1, the sorting system 106 is now described in greater detail with reference to FIGS. 2-6.

The sorting device 106 includes a classifier 200 for conveying solid waste, which as noted above may include lighter materials, such as paper materials, and heavier materials, such as plastic, glass and metal containers. The classifier 200 may have an inlet end 202 and an outlet end 204. Disposed between the inlet end 202 and the outlet end 204 may be one or more material separation sections or stages 206, 208, 210, each with an upstream end 212, 216, 220 and a downstream end 214, 218, 222 and each upstream end adjacent a downstream end, although this need not be the case according to all embodiments (i.e., other sections or stages may be disposed intermediate to the sections 206, 208, 210). As will be explained in greater detail below, the material separation section 208 may define a portion of an air handling system, which according to certain embodiments may be a closed loop air circulation system, although it is not believed that closed loop air circulation is required according to all embodiments of the present disclosure; the air system may draw air from and exhaust air to the environment instead.

Figure 2:
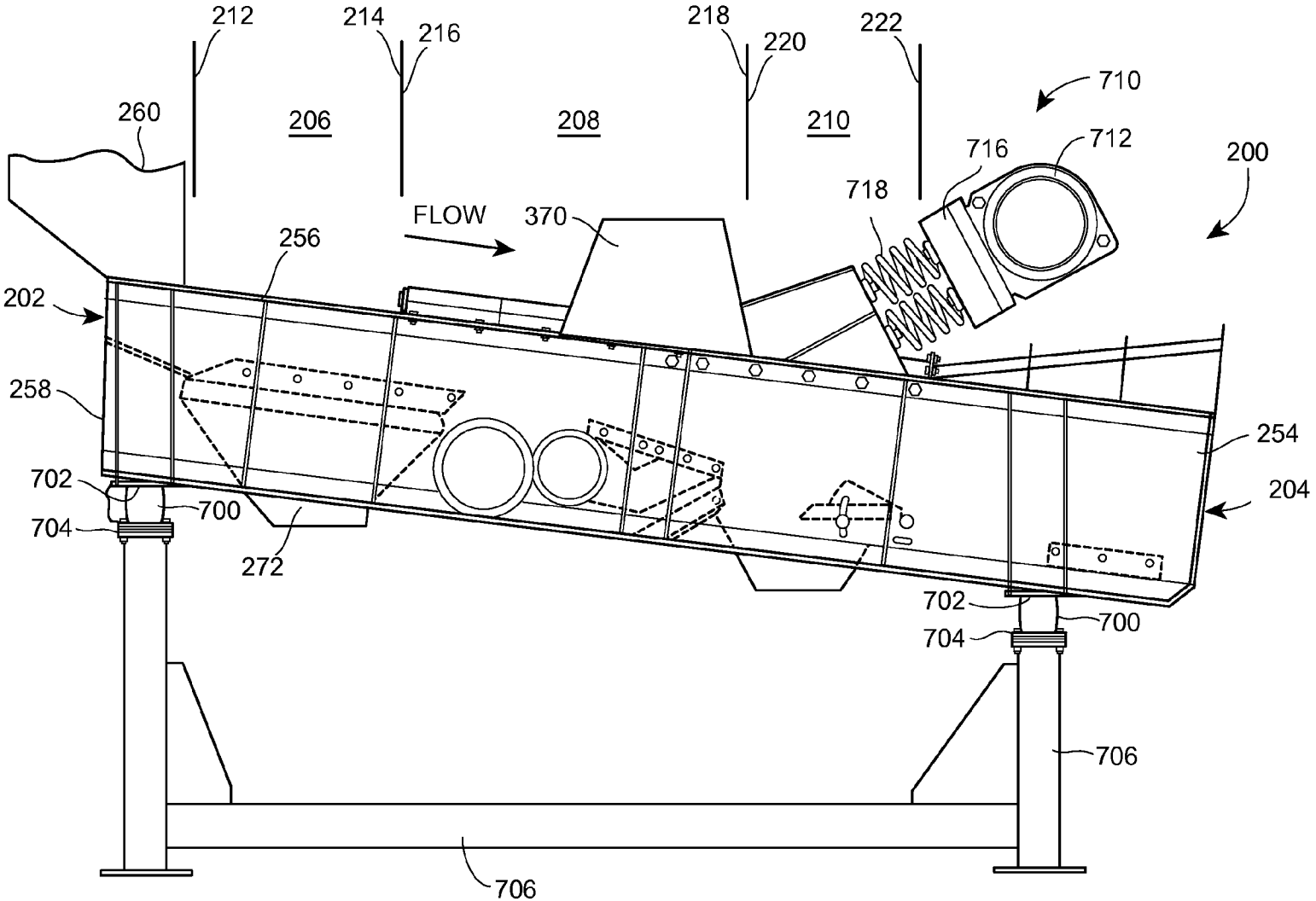
FIG. 2 is a side view illustrating an embodiment of the classifier used FIG. 1.
Figure 3:
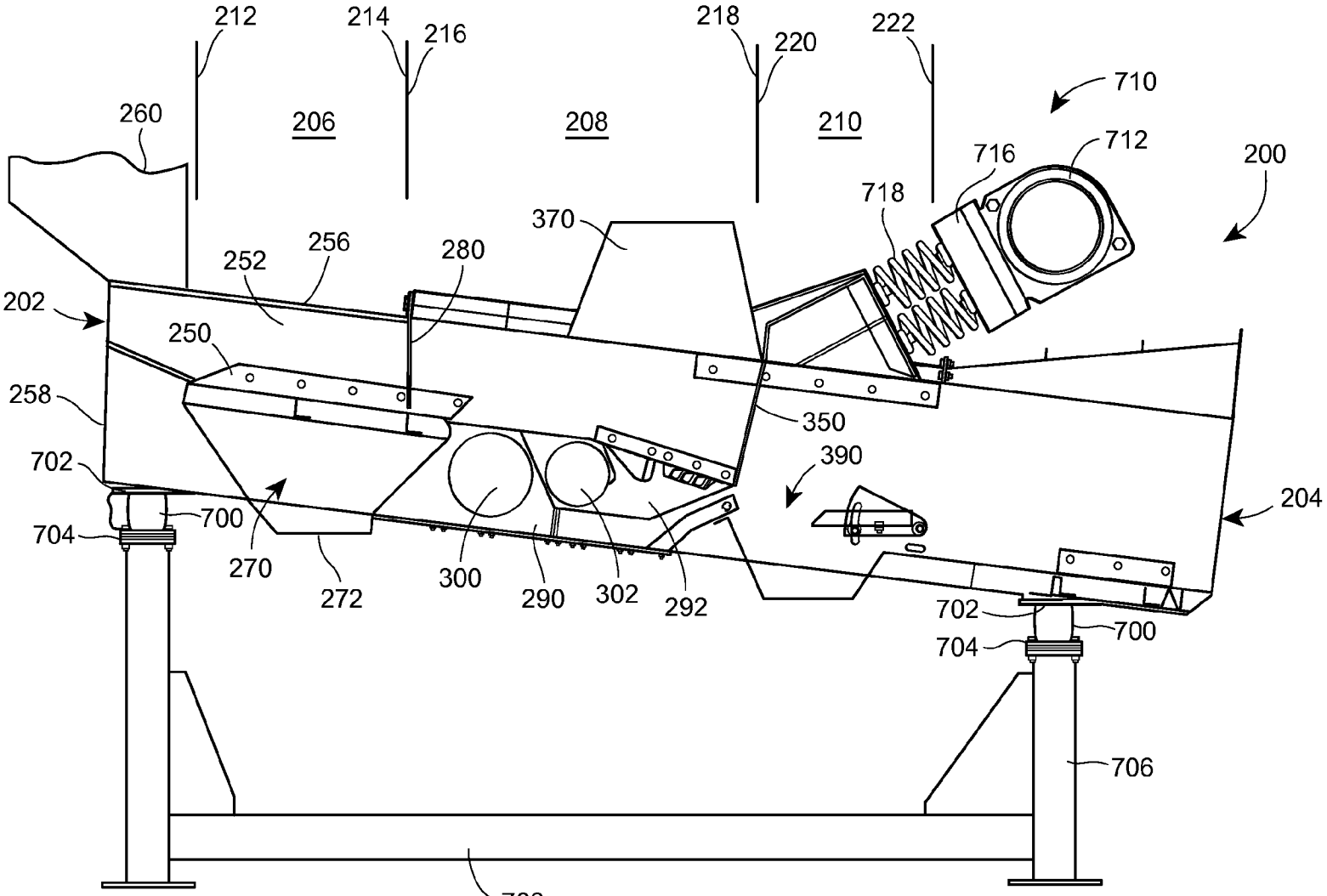
FIG. 3 is a cross-sectional view of the classifier of FIG. 2.

An exemplary first separation section or stage 206 is best illustrated in FIG. 3. The first separation stage 206 includes a deck 250 supported between opposing side walls 252, 254 (see FIGS. 2 and 3) and below a (first) hood 256 of the classifier 200. The classifier 200 may also include an end wall 258 that with the side walls 252, 254 and hood 256 defines an inlet 260 through which material to be passed along the classifier 200 from the inlet end 202 to the outlet end 204 may be received.

The deck 250 may be, for example, a finger screen deck or any other suitable deck with a plurality of small openings, apertures, or passages therethrough. Fine materials of a size and shape determined in accordance with the openings, apertures or passages of the deck 250 (or "fines" for short) may pass through deck 250 for collection. For example, the deck 250 may include a plurality of openings, apertures or passages sized so that particles smaller than 1.3 cm (0.5 inch) in width or diameter pass through the deck 250. To facilitate the collection of fine materials, the first separation stage 206 may include a first discharge chute 270 that defines a first outlet 272 to discharge, funnel, and collect any material that may pass through the deck 250.

It will be recognized that the system and device according to the present disclosure may function without the first separation section 206, and thus the section 206 is optional. However, it is believed that certain advantages may be obtained by first removing the fine materials from the other materials. According to other embodiments that do not incorporated a first separation section 206, a solid deck plate may be used in substitution for the screen section illustrated in FIG. 3. For that matter, a solid deck plate may be disposed over the deck 250 if there is no desire to provide an initial separation of the fines from the remainder of the materials passing through the classifier 200.

According to certain embodiments, an optional seal (e.g., a flap or plate) 280 may be disposed at the downstream end 214 of the first separation section 206 and the upstream end 216 of the second separation section 208. As illustrated, the seal 280 may be suspended from the hood 256 above a transition deck section 282 between the first separation section 206 and the second separation section 208. The seal 280 may be constructed of any suitable material, including, for example, cloth, rubber, and/or the like. The seal 280 may assist in creating confined spaces, which may facilitate control of the air conditions in each of the confined spaces, thereby simplifying the situation that may otherwise arise when the various separation sections 206, 208, 210 are in direct and uninterrupted fluid (e.g., air) communication with each other. According to other embodiments, this seal 280 may be removed or may not be present.

Figure 11:
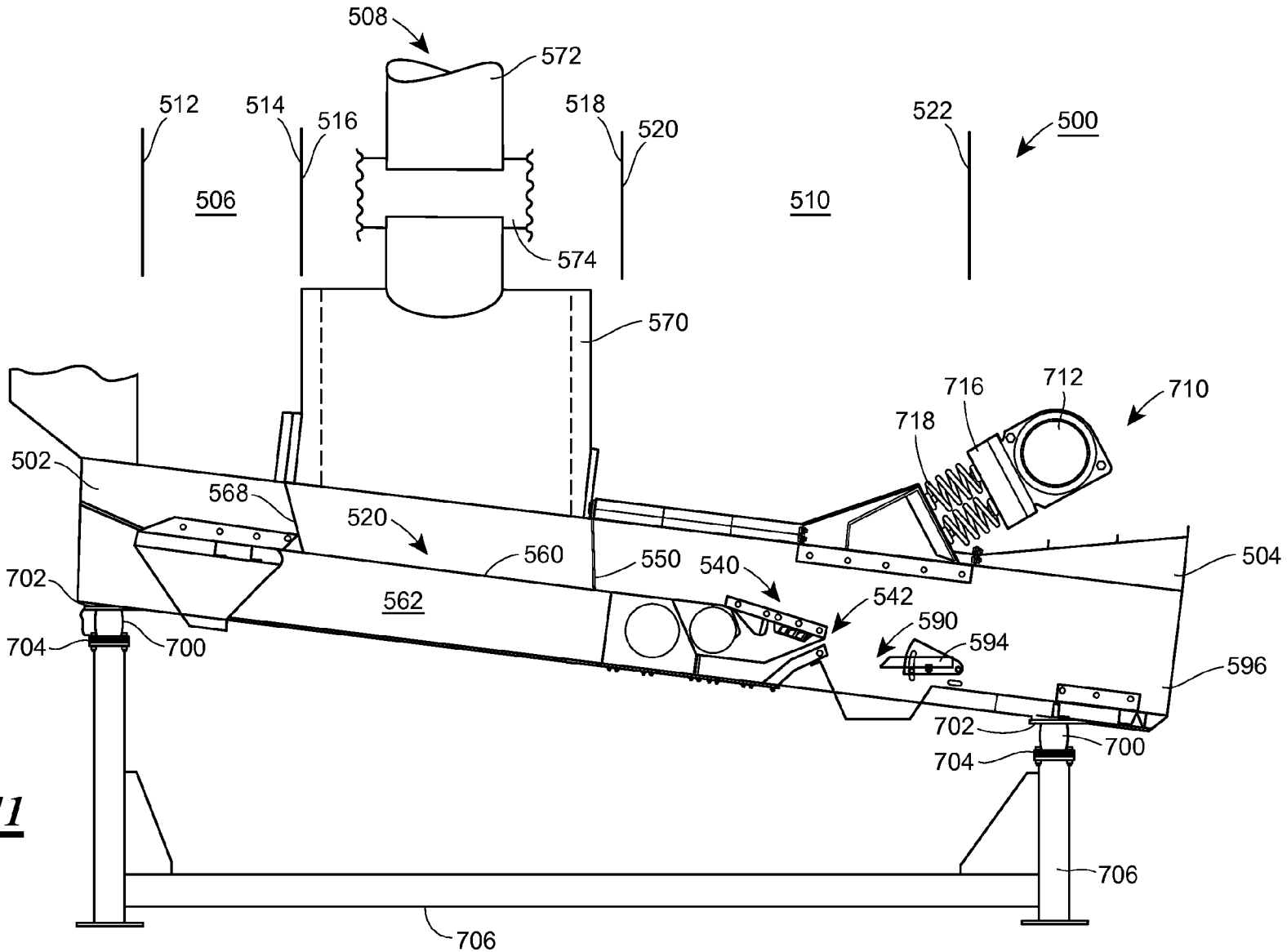
FIG. 11 is a cross-sectional view of an alternative embodiment of the sorting system for use in the system for sorting solid waste of FIG. 1.
Figure 12:
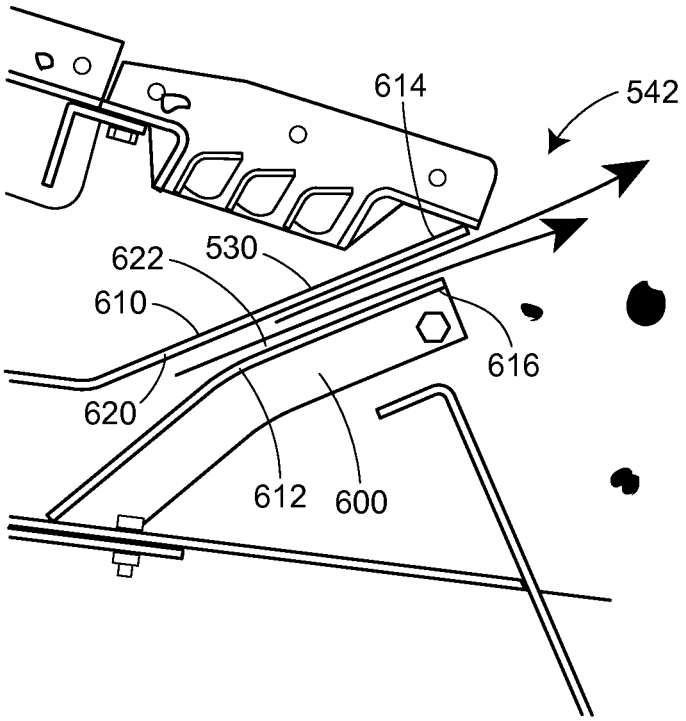
FIG. 12 is a further enlarged cross-sectional view of the air knife included in the third separation section of the classifier of FIG. 11.

The two separation sections 208, 210 may have several elements shared in common as illustrated in FIGS. 3-6. Alternatively, as illustrated in FIGS. 11 and 12, each separation section may include separate and distinct structures and equipment. As such, the present disclosure is intended to embrace both alternatives, as well as other alternatives that may not be illustrated but still remain within the scope of the present disclosure.

Figure 4:
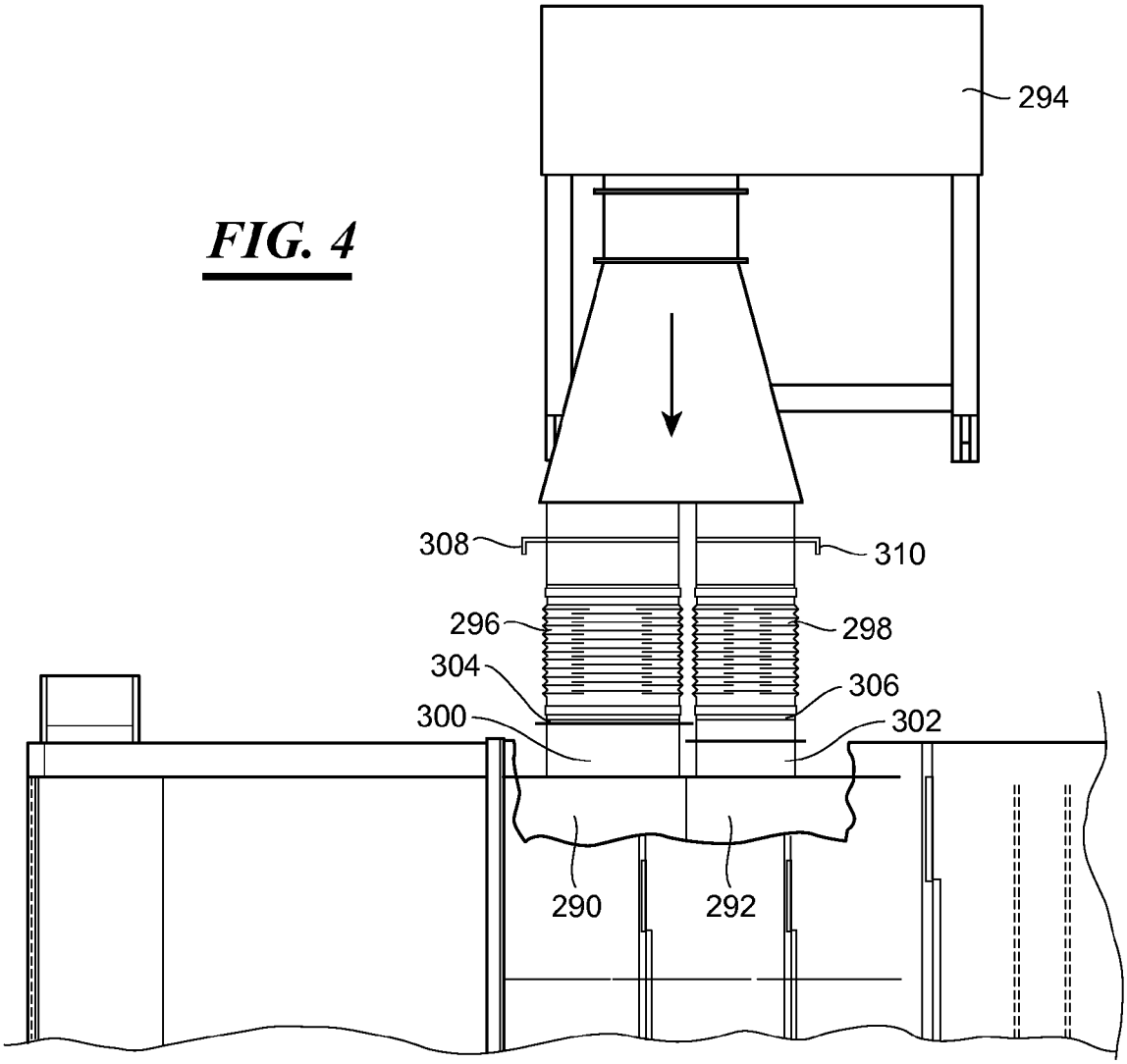
FIG. 4 is a plan view illustrating the connections between the classifier of FIG. 2 and an associated blower.

As illustrated then in FIGS. 3 and 4, the classifier 200 further includes a pair of chambers or plenums 290, 292 coupled to and in fluid communication with a single fan or blower 294 mounted separately from the classifier 200. As illustrated, the blower 294 communicates through a pair of flexible conduits 296, 298 with each plenum 290, 292 through air intakes 300, 302. The conduits 296, 298 may be attached to the air intakes 300, 302 through band clamps 304, 306. To vary the amount of air flowing through the conduits 296, 298 and intakes 300, 302 into the plenums 290, 292, one or more slide gates 308, 310 may be disposed between the plenums 290, 292 and the fan or blower 294. Alternatively or in combination, the blower 294 may include a motor with a variable frequency drive, which may permit the operation of the blower 294 to vary the characteristics of the air stream provided to the plenums 290, 292.

Figure 5:
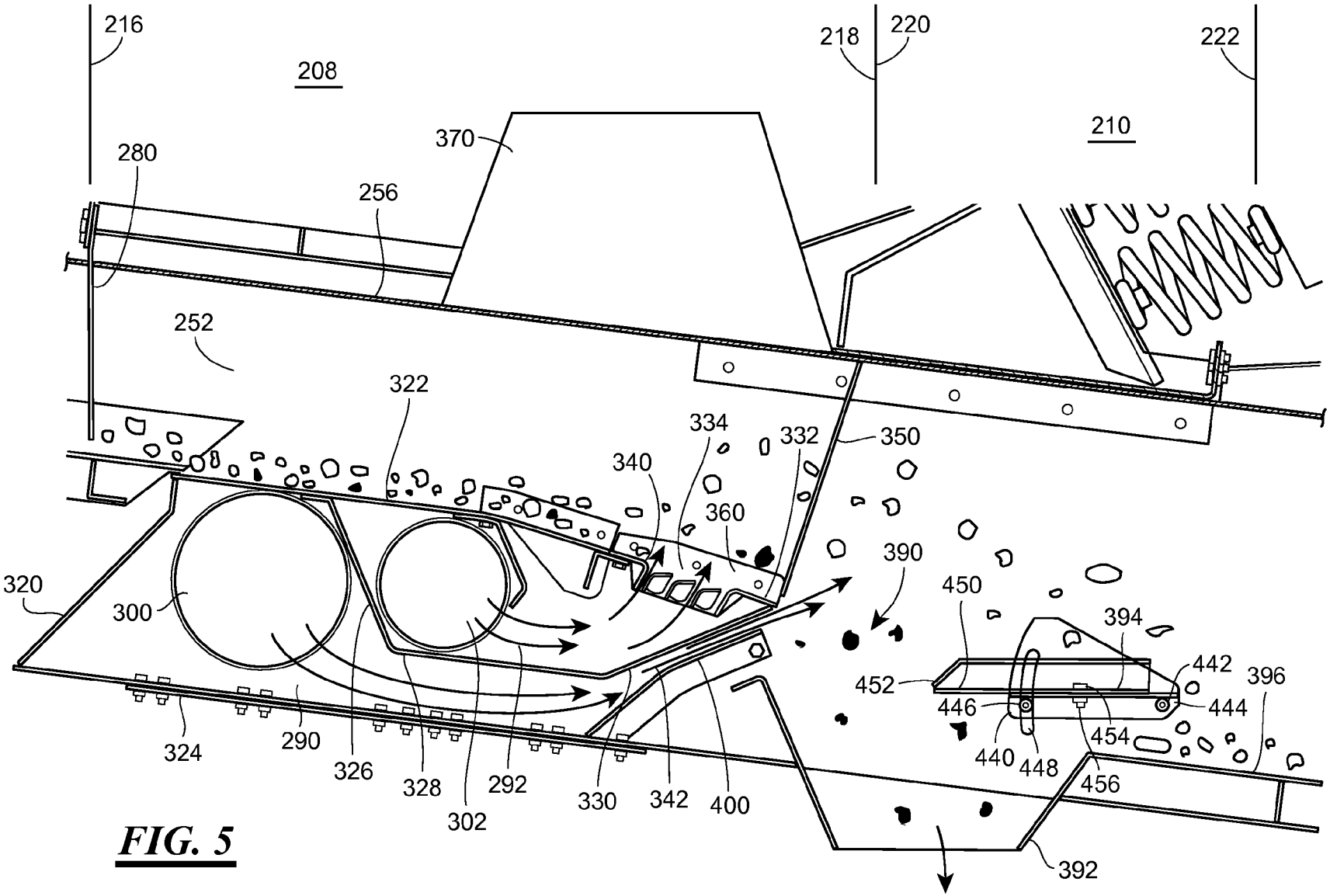
FIG. 5 is an enlarged cross-sectional view of the classifier of FIG. 2, showing the details of the second and third separations sections or stages, with a deflector plate in a first position.
Figure 6:
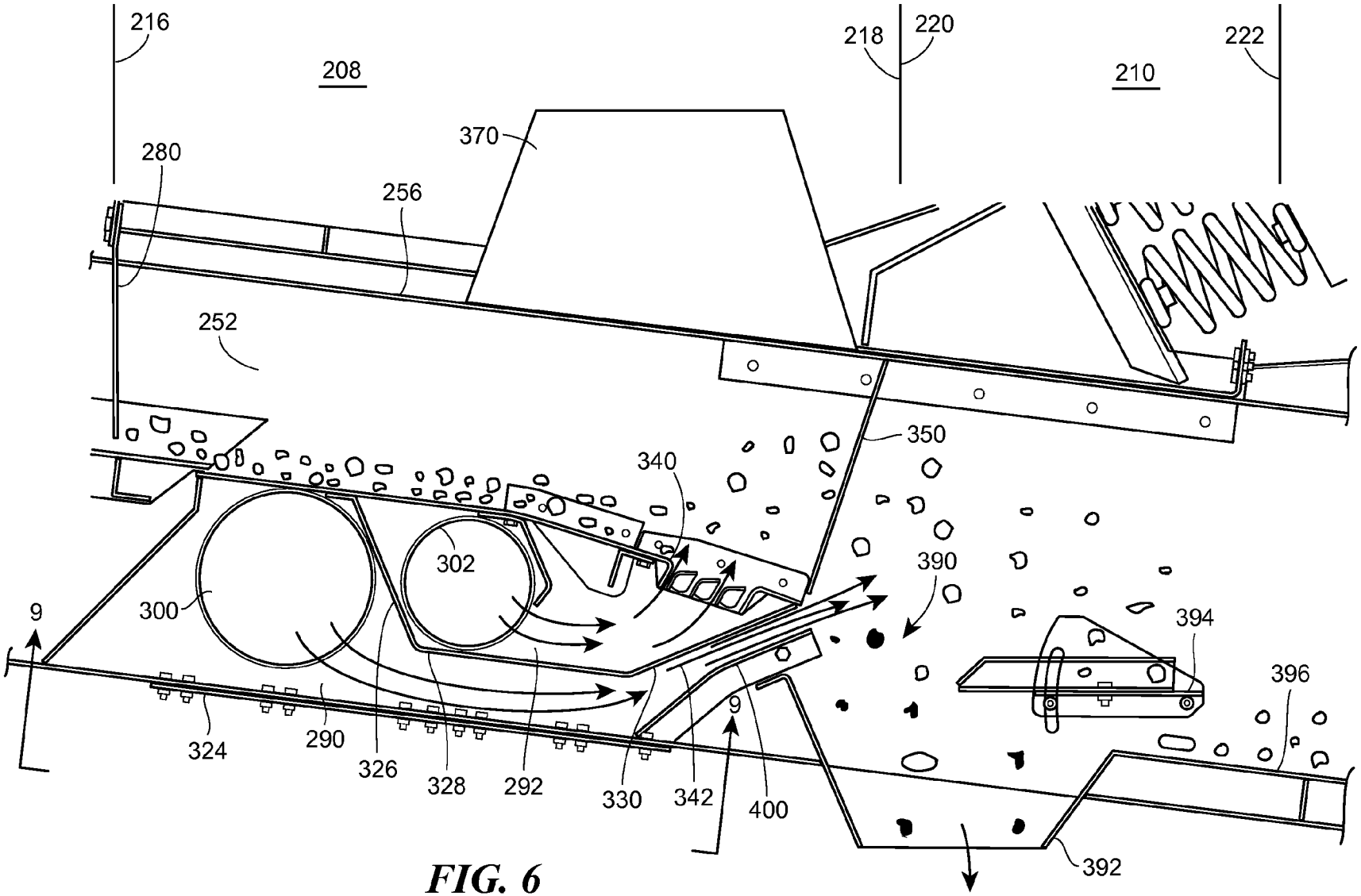
FIG. 6 is an enlarged cross-sectional view of the classifier of FIG. 2, similar to that of FIG. 5, with the deflector plate in a second position.

In addition to potentially sharing a common blower 294, the plenums 290, 292 may share one or more walls that are disposed between the opposing side walls 252, 254 to define the plenums 290, 292, as best illustrated in FIGS. 5 and 6. In particular, the plenum 290 may be defined by a first (downstream end) wall 320, a second (upper, or deck) wall 322, a third (bottom) wall 324, and a fourth (upstream end) wall 326, all of which are disposed between the side walls 252, 254. The plenum 290 may extend forward (or downstream) of the upstream end wall 326 along a corridor defined in part by the bottom wall 324 and a fifth (intermediate) wall 328. By comparison, the plenum 292 may be defined in part by the walls 322, 326, 328 and a further wall 330, as well as plate 332 having openings, apertures or passages 334.

It will be recognized that this is merely one embodiment of a classifier 200 according to the present disclosure, and the close interrelation of the equipment and structures that are coupled to and define the plenums 290, 292 is not required by all embodiments. For example, the plenums 290, 292 may be coupled to separate blowers, rather than be connected to a single blower 294 via a plurality of conduits or ducts. In addition, the present disclosure is not limited to an arrangement wherein the walls that define the plenum 290 define, at least in part, the plenum 292. Rather than having the plenums 290, 292 defined by different sections of wall 322 and on opposing sides of the walls 326, 328, the plenum 290 may be defined below the plenum 292 with no walls in common with the plenum 292. Such arrangements are also within the scope of the present disclosure.

The plenums 290, 292 are in fluid communication with a fluidizing section 340 and an air knife 342. In particular, the fluidizing section 340 is in communication with the plenum 292, while the air knife 342 is in communication with the plenum 290. In regard to overall layout of the classifier 200, the fluidizing section 340 is associated with the second separation section 208, while the air knife 342 is associated with the third separation section 210.

At least one physical demarcation may be provided between the second and third separation sections 208, 210 in the form of an optional seal 350, is disposed at the downstream end 218 of second separation section 208 and the upstream end 220 of the third separation section 210. In combination with the seal 280, the seal 350 may act to isolate the second separation section 208 from the remainder of the classifier 200. As to the structure and materials for the seal 350, it will be recognized that the comments made above relative to the seal 280 may apply similarly to the seal 350.

Addressing the second separation section 208 in greater detail, it will be recognized that the fluidizing section 340 may be defined by a fluidizing deck 360 that may be disposed in fluid communication with the plenum 292. In fact, the deck 360 may be defined by the plate 332 that also defines, in part, the plenum 292; other embodiments may include structures (e.g. corridors, conduits or ducts) disposed between the plenum 292 and the deck 360. In regard to the illustrated embodiment, the fluidizing deck 360 may also be described as lying in a plane above the plenum 292 extending between the deck wall or plate 322 and the air knife 342.

The deck 360 supports the solid waste while accommodating passage of air upwardly from the plenum chamber 292, through the plurality of openings, apertures or passages 334. The deck 360 may alternatively be described as being defined by or having a foraminous surface with openings 334; according to certain embodiments the openings may be louvered openings. The openings, apertures, or passages 334 may have a particular angle or angular orientation relative to the surface of the plate 332; for example according to certain embodiments, the openings 334 may direct the air so that it exits generally perpendicular to the surface of the plate 332. The size of the openings 334 may be selected according to the fluidizing properties or characteristics of the material. For example, heavier and/or larger materials may require more fluidizing air and therefore larger openings may be used, while lighter and/or smaller materials may required less fluidizing air and therefore smaller openings may be used. The air is directed upwardly from the plenum 292 through the solid waste passing over the fluidizing section 340 to cause fluidization of the heavier objects and separation of the lighter materials (e.g., paper) therefrom.

In addition to the fluidizing deck 360, the second separation section 208 also includes a (second or exhaust) hood 370 that is disposed above the fluidizing section 340, and the deck 360 in particular. The hood 370 may be a separate part of the system, retrofitted to existing equipment. A negative pressure is developed adjacent the section 340 or deck 360 by an air handling system that is in fluid communication with the hood 370. The paper (which may also be referred to as the "ultra-lights" herein) may then be drawn into the hood 370 once it is separated from the heavier objects by virtue of a negative pressure generated thereby adjacent the fluidizing section 340.

Figure 7:
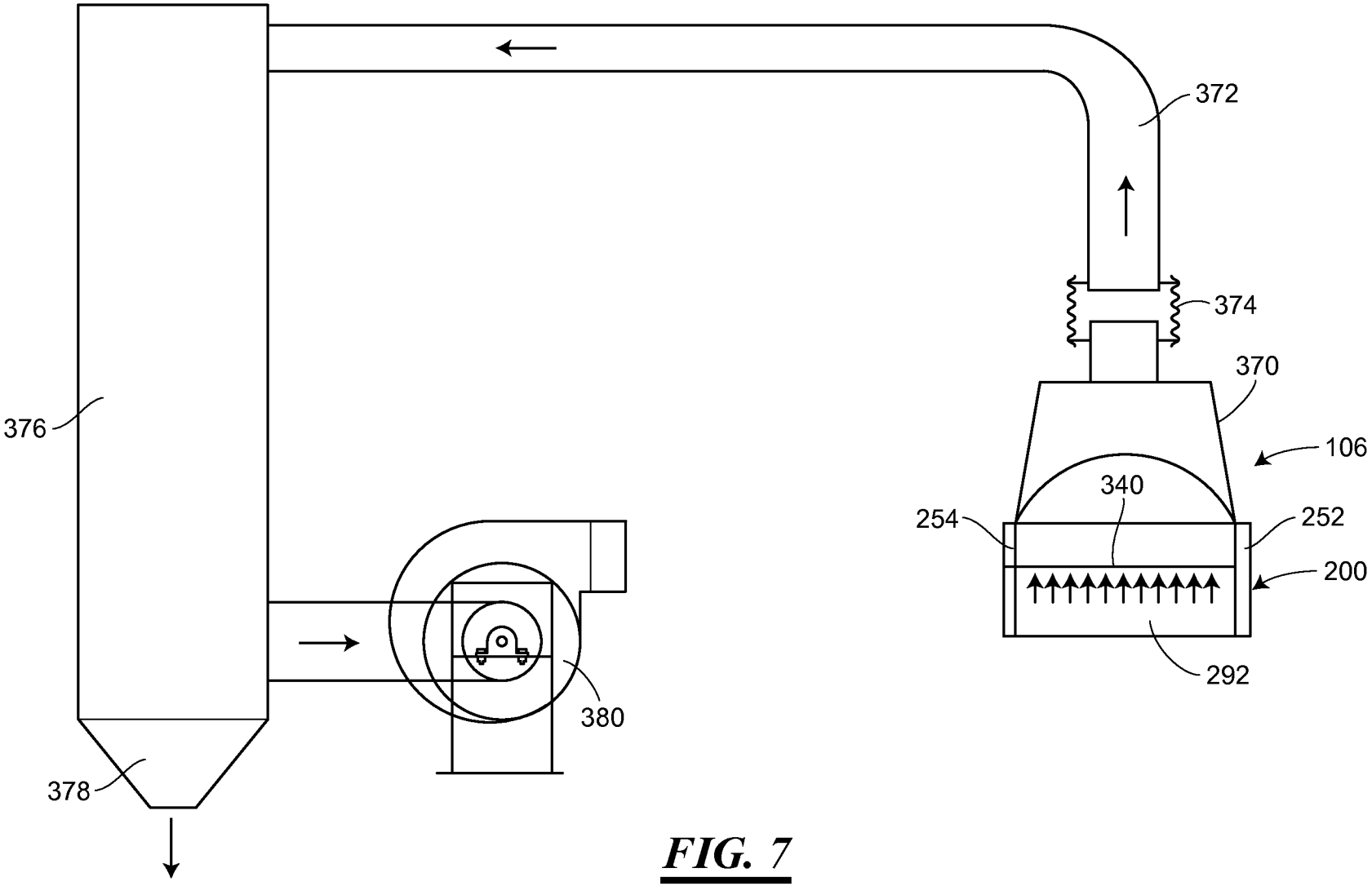
FIG. 7 is a schematic view of an air handling system in combination with the second separation section of the classifier of FIG. 2.

In particular, it will be noticed with reference to FIG. 7, that the hood 370 is coupled to and in communication with an air duct 372, which may be flexibly connected as at 374 to the exhaust hood 370 and extend therefrom. The duct 372 may be coupled to and in communication with systems or devices to remove the paper (and other ultra-light materials) that will become entrained with the air stream entering the exhaust hood 370. For example, the system may also include a dust collector or expansion box 376 downstream of the hood 370 for removing paper from the system 230. While the paper may exit the separator 376 at an outlet 378, air may pass from the collector 376 to a fan or blower 380 that draws air through the hood 370, duct 372 and collector 376 so as to generate a negative pressure adjacent the section 340 or the deck 360.

According to other embodiments, one or more of adjustable plates may be associated with the hood 370 or the duct 372, which plates may be advanced and withdrawn to control air flow velocity through the exhaust hood 370; in the alternative, a blower 380 with motor coupled to a variable frequency drive may be used. According to still other embodiments, the dust collector or expansion box 376 may be optional. Instead, the blower 380 may be a fan capable of receiving the air stream with entrained paper and to direct the paper into a container, such as a bag. The blades of the blower 380 may shred the entrained paper at the same time as it is directed into the bag.

In addition to causing the ultra-light materials to be separated from the other materials, the fluidizing deck also has a potential beneficial effect relative to the air knife 342, which is discussed in greater detail below. In particular, the vibratory motion of the classifier 200 may cause the solid waste, which is a composite material including of materials of various densities, to tumble, and may agitate larger conjoined clumps of material of varying weights and densities against each other. The vibratory motion of the classifier 200 also causes the solid waste to move over the fluidizing deck 360 whereby the material is fluidized as it passes over the openings 334 in the plate 332. Air from the plenum 292 passing through the openings 334 may cause the solid waste to tumble, and may agitate larger clumps of joined or attached materials. As a further consequence, a bed of solid waste materials is formed, with the heavier or denser materials collecting in the lower portions or levels of the bed and the lighter or less dense materials collecting in the upper portions or levels of the bed. In fact, the lighter materials may bob and jump above the upper portions of the bed. The separation and stratification of the materials in the bed of solid waste may facilitate its separation in the separation section 210. For example, the separation and stratification of the materials may facilitate the movement of the heavier particles through the adjustable air knife 342 (i.e., the air, air stream or air column formed by the air knife 342) by limiting the interaction of the lighter materials with the heavier materials which may cause incomplete separation.

Moving along the classifier 200 to the third separation section 210, the materials that were not removed by the first and second separation sections 206, 208 will be passed over the air knife 342, which may be an adjustable air knife as illustrated. The heaviest materials, such as the glass and metal containers, will pass through a dropout 390 that defines a third outlet 392. However, because the air knife 342 directs air upward into the dropout 390, the lighter materials, such as the plastic containers, will pass over the dropout 390 and onto a solid deck section 394. The lighter materials move along the deck section 394 to a fourth outlet 396 defined at the outlet end 204 of the classifier 200.

The air knife 342 is defined by a fixed plate or wall and a moveable deflector plate or wall 400. According to the illustrated embodiment, the fixed wall is defined by the wall 330, although it is not necessary that the fixed wall define, in part, the plenum 292. In fact, it may also be possible to have an air knife 342 that is defined by two moveable plates, in that it is the relative motion between the wall 330 and the deflector plate 400 that determines the width of the passage through which the air passes, and thus the velocity of the air knife 342 as will be explained in greater detail below.

The wall 330 and the deflector plate 400 are angled relative to the deck wall 322 and the plate 332 that defines the fluidizing deck 360. Thus the air knife 342 has an upwardly directed trajectory: i.e., the air flowing in the passage between the wall 330 and the deflector plate 400 was an upwardly directed trajectory. While the angle between the direction of the air flowing between the wall 330 and the deflector plate 400 is an acute angle of approximately 45-60 degrees, it will be recognized that the angle could be smaller or larger than that illustrated.

Figure 8:
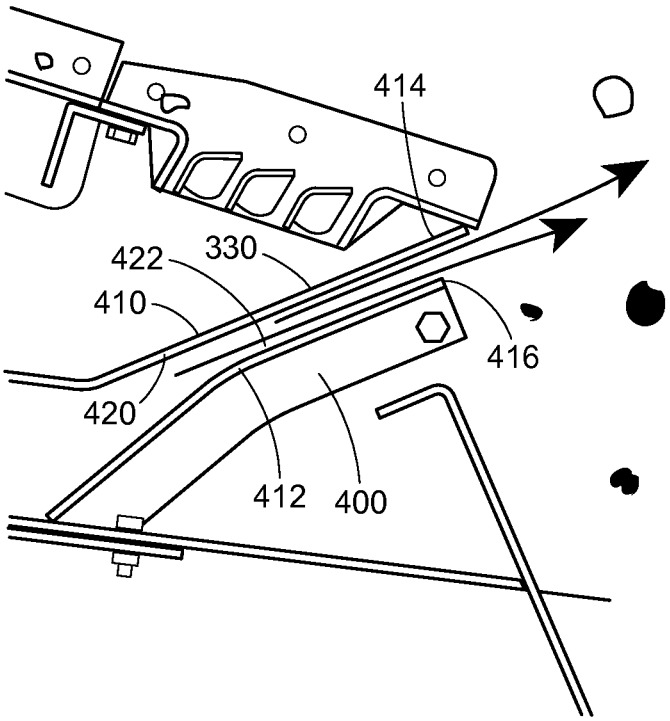
FIG. 8 is a further enlarged cross-sectional view of the an air knife included in the third separation section of the classifier of FIG. 2.

The deflector plate 400 runs generally parallel to the wall 330. Moreover, this parallel orientation between the wall 330 and the deflector plate 400 is maintained even as when the plate 400 is moved relative to the wall 330. As seen in FIG. 8, as the deflector plate 400 is moved or shifted, the distance between a first end 410 of the wall 330 and a first end 412 of the deflector plate 400 remain substantially the same as the distance between a second end 414 of the wall 330 and a second end 416 of the deflector plate 400. That is, the distance between the first ends 410, 412 and the distance between the second ends 414, 416 in either of a first or a second position is not so different as to change the orientation of a surface 420 of the wall 330 and a surface 422 of the plate 400 more than 5 degrees. Stated slightly differently, when the plate 400 moves relative to the wall 330, it translates from between first position and a second position without significant rotation, for example about its first end 412.

So then, returning then to FIG. 5, the deflector plate 400 is illustrated in the first position. Specifically, the deflector plate 400 is disposed relative to the wall 330 such that the width of the air knife 342 is narrow. In this example, the width of the air knife 342 may be approximately between approximately 2.5 cm (1 inch) to 3.2 cm (1¼ inches). With the deflector plate 400 disposed as illustrated in FIG. 5 (i.e., in the direction of or towards the wall 330), the air, air stream or air column passing between the wall 330 and the deflector plate 400 into the dropout 390 may have a characteristically high velocity, narrow width profile. The high velocity, narrow width profile may be well suited for separating two or more commingled, relatively light objects.

As illustrated in FIG. 6, the deflector plate 400 is disposed in the second position. In this position, the deflector plate 400 is disposed relative to the wall 330 such that the width of the air knife 342 is broad. With the deflector plate 400 disposed as illustrated in FIG. 6 (i.e., in the direction of or away from the wall 330), the air, air stream or air column passing between the wall 330 and the deflector plate 400 into the dropout 390 may have a characteristically low velocity, wider width profile. The low velocity, wider width profile may be well suited for separating other, heavier commingled objects.

Whatever the distance or spacing between the wall 330 and the deflector plate 400, it will be recognized that the operation of the air knife 342 is such that the higher density materials will substantially pass through the air column and the dropout 390. The less dense materials will be substantially carried by the air column and will pass onto or over the deck section 394 and out the outlet 396 at the outlet end 204 of the classifier 200. Graduated adjustments to the distance or spacing between the wall 330 and the deflector plate 400 may be made to choose a desired line of separation. By adjusting the widths of the air column, the classifier 200 may be configured to separate a variety of composite mixtures without alteration to the structure (e.g., length) of the classifier 200. In this way, a single classifier 200 may be used to separate solid waste streams of varying composition (e.g., percentages of plastic containers, glass containers, and metal containers).

Figure 9:
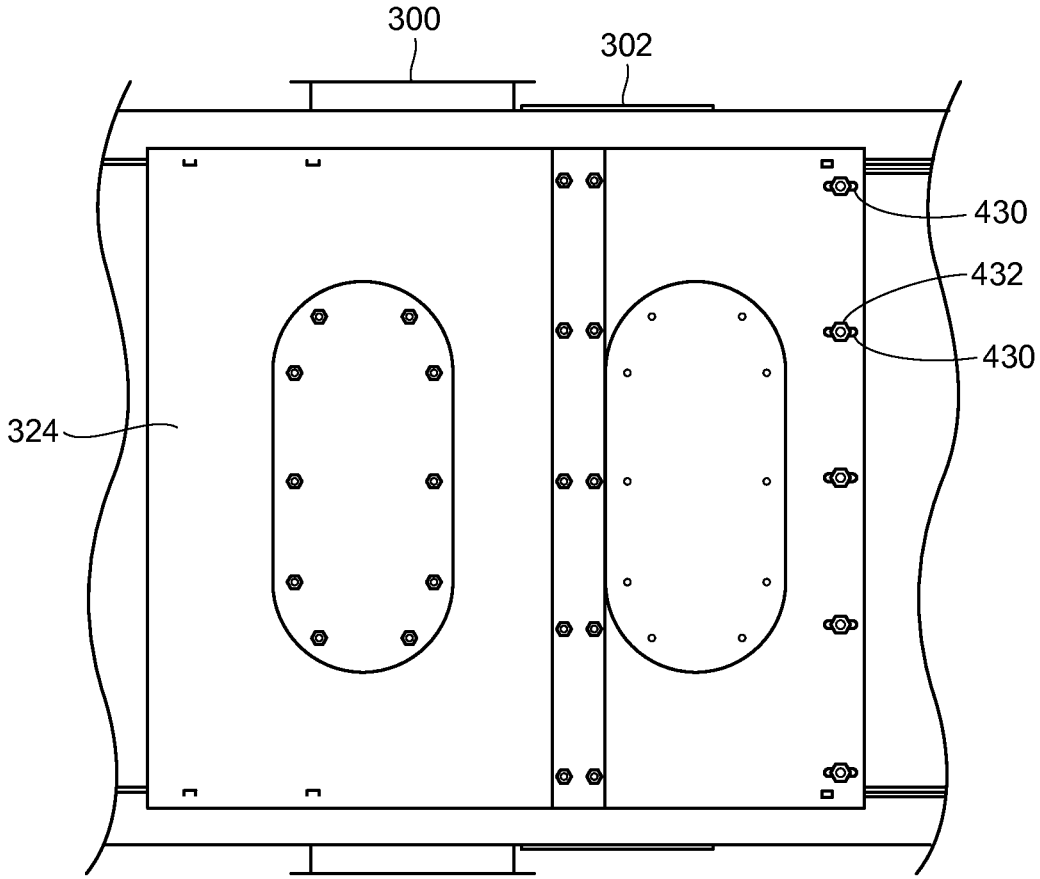
FIG. 9 is a bottom view of the classifier of FIG. 2, illustrating one embodiment of a mechanism for attaching the deflector plate to secure it in either the first or the second position.

It will be recognized that it will be necessary to mount the deflector plate 400 to the remainder of the classifier 200. For example, the bottom wall 324 may extend some distance past the wall 330 into the dropout 390, and the deflector plate 400 may be adjustably mounted to the bottom wall 324 so as to be shiftable (i.e., translatable without substantial rotation) between the first position (FIG. 5) and the second position (FIG. 6). In fact, the planar nature of the bottom wall 324 may assist in ensuring that the deflector plate 400 translates along a substantially straight line that maintains the wall 330 and the plate 400 (or at least a surface of the wall 330 and the plate 400) in a parallel relationship with each other. As to the mechanism used to adjustably mount the deflector plate 400 to the bottom wall 324, one embodiment is illustrated in FIG. 9 wherein the deflector plate 400 is mounted to the bottom wall 324 through the use of at least one transverse slot 430 in which a fastener 432 may be received. The fastener 432 (such as a nut and bolt combination) may be secured (tightened) and unsecured (loosened) to permit the plate 400 to be moved between the various positions, the motion of the plate 400 being guided by the movement of the fastener 432 within the slot 430.

As mentioned previously, the materials that pass over the dropout 390 are received on a solid deck section 394. As illustrated, in FIG. 5 for example, the solid deck section 394 (or landing plate) may be adjustable to vary the angle of the surface of the landing plate 394, and may also be adjustable to vary the size of the dropout 390.

For example, as illustrated, the landing plate 394 may includes flanges 440 on each side edge of the plate 394. A pivot rod 442 passes through at least one opening (not shown) formed in each of the side walls 252, 254 of the classifier 200 and is secured thereto by, for example, nuts threaded on to threaded ends of the rod. Each flange 440 has an opening 444 through which the rod 442 passes to secure the flange 440 to the side walls 252, 254 of the classifier 200. Each flange 440 may also have at least one additional opening to receive a fastener 446 (such as a nut and bolt combination) that is also received in one of a pair of opposed arcuate shaped slots 448. By securing the fastener at different positions along the slot 448, the angular position of the surface of the plate 394 may be varied.

Additionally, mounted on the plate 394 is an extension plate 450. The extension plate 450 is moveable (slidable) along the surface of the plate 394, such that an edge 452 of the extension plate 450 moves either toward or away from the drop out 390. The slideable adjustment may be achieved through the use of threaded studs 454 attached to (e.g. welded to) the undersurface of the extension plate 450, which studs may be received in slots in the plate 394 which may be combined with a nut 456 to secure the relative position of the extension plate 450 relative to the landing plate 394.

Figure 10:
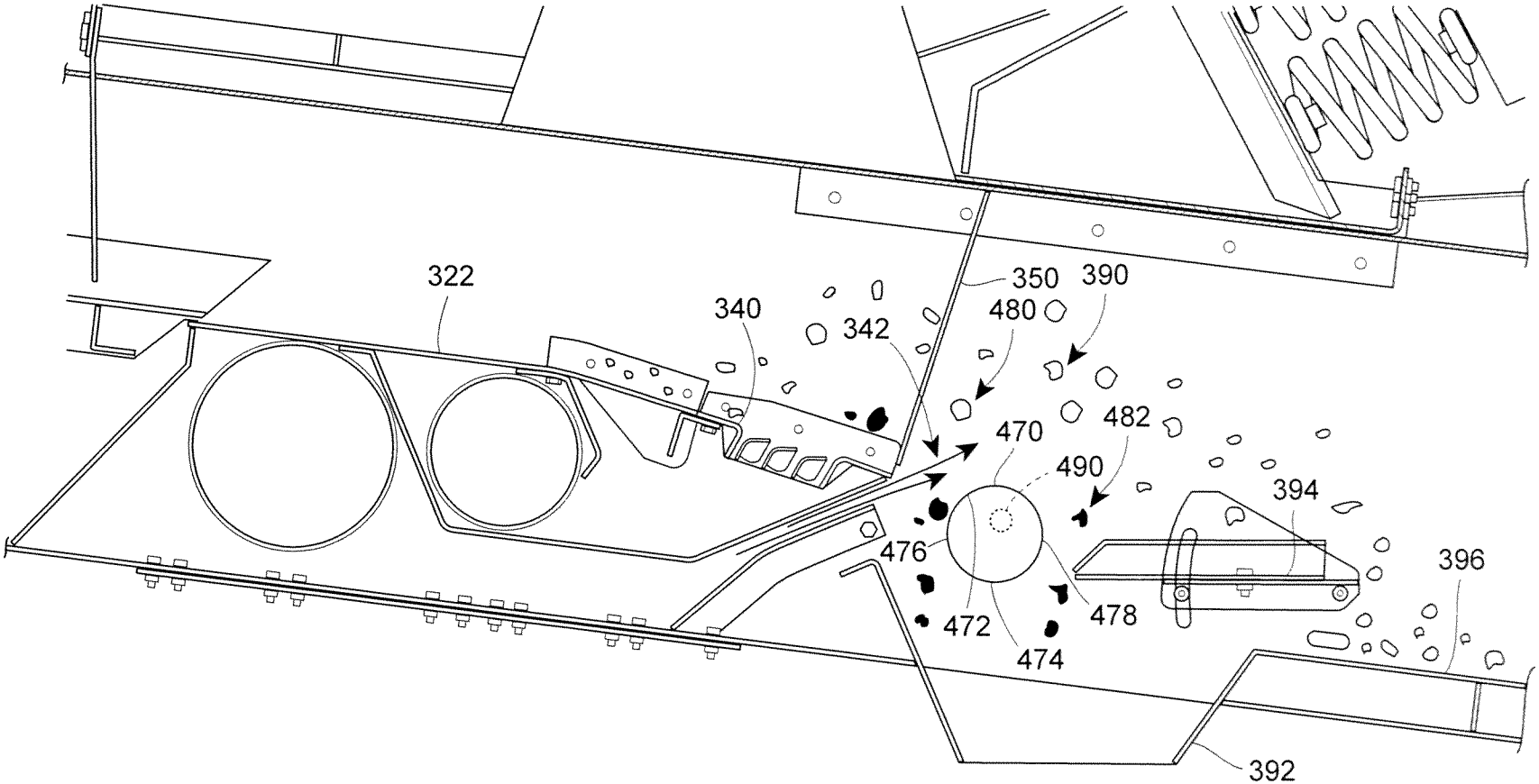
FIG. 10 is an enlarged cross-sectional view of the classifier of FIG. 2 showing the details of a variant to the third separation section illustrated in FIGS. 5 and 6.

According to still further embodiments of the present disclosure, the third separation section 210 of the classifier 200 may have an optional separation member, such as the exemplary separation tube 470 illustrated in FIG. 10. In the illustrated embodiment, the separation tube 470 is a cylindrical tube having a generally circular cross section and includes an upper surface 472, a lower surface 474, a leading edge 476, and a trailing edge 478. According to alternative embodiments, the separation tube 470 may have any suitable shape, including, for example, semi-circular, arcuate, annular, air foil, or the like. The size (e.g., diameter) of the tube 470 may be varied as well.

The separation tube 470 may be disposed between the side walls 252, 254 and in the dropout 390 between the fluidizing deck 340 and air knife 342 on one hand and the landing plate 394 on the other. The separation tube 470 may be spaced to define a first dropout sub-opening 480 and a second dropout sub-opening 482. In the illustrated example, the separation tube 470 is positioned so as to interact with the air stream produced by the air knife 342 to produce desirable air flow characteristics. In one example, the separation tube 470 may be spaced further away from the air knife 342 than the landing plate 394.

In operation, the separation tube 470 interacts with the air column produced by the air knife 342 to aid in the separation of the composite material. Specifically, with the separation tube 470 disposed within and/or below the air stream formed by the air knife 342, the separation tube 470 is intended to produce an "air-foil" effect on the air stream whereby at least a portion of the air stream travels over the upper surface 472 of the separation tube 470. Stated slightly differently, the "air-foil"-effected air stream is intended to have a "lift and carry" effect on any material traveling within the stream.

As such, it will be recognized that material having a relatively dense structure will pass through the air stream from the air knife 342 fall through the first dropout sub-opening 480. Alternatively, some material having a relatively dense structure will strike the leading edge 476 of the separation tube 470 and will be deflected downward through the first dropout sub-opening 480. The remaining material, however, may be lifted and carried by the "air-foil"-effected air stream over the separation tube 470. Of the remaining material carried over the separation tube 470, some of the larger remaining particles may be heavy enough to fall out of the "air foil"-affected air stream, and fall through the second dropout sub-opening 482, ultimately passing through the outlet 392. The remaining lighter materials (e.g., plastic containers) will continue to be propelled over the separating tube 470, over the second dropout sub-opening 482, and toward the landing plate 394, where they will be conveyed to the outlet 396. By varying the shape and position of the separation tube 470, as well as by optionally varying the width and/or velocity of the air stream, the classifier 200 may be optimized for a variety of composite mixtures.

The separation tube 470 may be mounted to the classifier between the side walls 252, 254 through the use of a shaft 490 positioned eccentric with respect to a center of the tube 470. Accordingly, the position of the separation tube 470 may vary within the dropout 390 by rotating the tube 470 about the shaft 490. Alternatively, the separation tube 470 may be mounted on an adjustable shaft (not shown), such as a shaft mounted in a generally transverse slot, such that the position of the tube 470 may be varied.

Having thus discussed one embodiment of the present disclosure relative to FIGS. 2-10, a further embodiment of the present disclosure is now discussed relative to FIGS. 11 and 12. In this regard, the further embodiment is similar to that illustrated in FIGS. 2-10 in that it includes three separation sections, which have been marked as 506, 508, 510 similar to the sections 206, 208, 210 of the classifier 200 illustrated in FIGS. 2-8. In this regard, much of what has been disclosed in regard to the sections 206, 208, 210 applies with equal force in regard to sections 506, 508, 510, for example as relates to the optional nature of the first separation section 206 or 506. However, unlike the second and third separation sections 208, 210, the second and third separation sections 508, 510 are not interconnected to the same degree.

In particular, as is illustrated in FIG. 11, the second separation section 508 includes a fluidizing section 520, while the third separation section 510 also includes a fluidizing section 540 and an air knife 542. In this regard, a flap, plate or seal 550 may be disposed between the fluidizing section 520 and the fluidizing section 540 to separate the two fluidizing sections 520, 540. However, the sections 520, 540 are separated by more than simply the seal 550.

In particular, the fluidizing section 520 includes a fluidizing deck 560 disposed in communication with a plenum 562. In fact, the deck 560 may be defined by a plate having a plurality of openings, apertures, or passages formed therethrough. The plate may define, at least in part, the plenum 562, while in other embodiments structures (e.g., corridors, conduits or ducts) may be disposed between the plenum 562 and the deck 560. As illustrated, the deck 560 may extend between the seal 550 and an upstream (relative to the flow of the solid waste) seal 568.

As relates to the structure and operation of the deck 560, as well as that of the associated hood 570, reference may be made relative to the deck 360 and associated hood 370. In particular, the hood 570 is disposed above the fluidizing deck 560, and a negative pressure is developed adjacent the deck 560 by an air handling system that is in fluid communication with the hood 570. Paper may be drawn into the hood 570 once it is separated from the heavier objects by virtue of a negative pressure generated adjacent the deck 560.

In particular, the hood 570 may be coupled to and in communication with an air duct 572, which may be flexibly connected as at 574 to the exhaust hood 570 and extend therefrom. The duct 572 may be coupled to and in communication with systems or devices to remove the paper (and other ultralight materials) that will become entrained with the air stream entering the exhaust hood 570. For example, the system may also include a dust collector or expansion box downstream of the hood 570 for removing paper. While the paper may exit the separator at an outlet, air may pass from the collector to a fan or blower that draws air through the hood 570, duct 572 and collector so as to generate a negative pressure adjacent the deck 560. Other comments made in regard to the hood 370 and associated air handling equipment may apply equally here as well.

Moving along the classifier 500 to the third separation section 510, the materials that were not removed by the first and second separation sections 506, 508 will be passed over the air knife 542, which may be an adjustable air knife as illustrated. The heaviest materials, such as the glass and metal containers, will pass through a dropout 590 that defines a third outlet 592. However, because the air knife 542 directs air upward into the dropout 590, the lighter materials, such as the plastic containers, will pass over the dropout 590 and onto a solid deck section 594. The lighter materials move along the deck section 594 to a fourth outlet 596 defined at the outlet end 504 of the classifier 500.

Of course, it will be recognized that the third separation section 510 differs from the third separation section 210 in that the separation section 510 includes a separation deck 596 separate and apart from the separation deck 560 that is part of the second separation section 508. However, this separation deck 540 and the adjustable air knife 542 may reflect the same degree of interconnection as illustrated above relative to the separation section 340 and the air knife 342, and the deck 540 and the air knife 542 may include equipment and structures that are coupled to and define both the deck 540 and the air knife 542.

For example, it will be recognized that the deck 540 and the air knife 542 may be coupled to plenums that may be connected to conduits connected to a common blower. Moreover, these plenums may be defined by walls or plates, at least certain of which define at least in part the plenum in communication with the deck 540 and the plenum in communication with air knife 542. Moreover, the operation of the deck 540 may permit a separation and stratification of the heavier and lighter materials prior to passage over the air knife 542 so as to facilitate the separation possible through use of the air knife 542.

Furthermore, as illustrated in FIG. 12, the air knife 542 may be defined by a fixed plate or wall 530 and a moveable deflector plate or wall 600. The wall 530 and the deflector plate 600 are angled relative to a plate that defines the fluidizing deck 540. The deflector plate 600 (or at least a surface of the plate 600) runs generally parallel to the wall 530 (or at least a surface of the wall 560). Moreover, this parallel orientation between the wall 530 and the deflector plate 600 is maintained even as when the plate 600 is moved relative to the wall 530. That is, as the deflector plate 600 is moved or shifted, a distance between a first end 610 of the wall 530 and a first end 612 of the deflector plate 600 and a distance between a second end 614 of the wall 560 and a second end 616 of the deflector plate 600 remains substantially the same. Whatever the distance or spacing between the wall 560 and the deflector plate 600, it will be recognized that the operation of the air knife 542 is such that the higher density materials will substantially pass through the air column and an associated dropout. The less dense materials will be substantially carried by the air column and will pass onto or over a deck section and out an outlet at an outlet end of the classifier 500.

Given the similarity between the air knife 342 and the air knife 542, it is not believed to be necessary to repeat or recount the disclosure in regard to the air knife 542, other than to state that the variants and alternative discussed in regard to the air knife 342 apply equally to the air knife 542.

As noted above, either variant of the classifier 200, 500 utilizes a vibration generator to convey material from inlet end 202, 502 to outlet end 204, 504. FIGS. 2, 3 and 11 illustrate an embodiment of a type of vibratory apparatus that may be used as the classifier 200, 500. It will be recognized that other feeders and conveyors may be used instead of the embodiment illustrated in FIGS. 2 and 3. However, an embodiment has been illustrated so that the additional details of the classifier 200, 500 may be discussed.

As illustrated in FIGS. 2, 3 and 11, the classifier 200, 500 is supported on a plurality of resilient members 700, two of which may be disposed at the inlet end 202, 502 of the classifier 200, 500 and two of which may be disposed at the end outlet 204, 504 of the classifier 200, 500. The resilient members 700, which may be in the form of coil springs or marshmallow-type springs, may have a first end 702 coupled to the separation sections 206, 208, 210, and a second end 704 coupled to a frame 706 attached to the ground. The resilient members 700 may be referred to as isolation members, or isolation springs.

The classifier 200, 500 also includes a vibration generator 710, which may include a motor 712 having one or more eccentric weights (not shown) attached to the ends of the motor shaft. The motor 712 may be attached to a base plate 716 which is coupled to the separation sections 206, 208, 210 or 506, 508, 510. In particular, a plurality of resilient members 718 may be attached between the base plate 716 and the sections 206, 208, 210 or 506, 508, 510, with their first ends coupled to the plate 716 and their second ends coupled to the sections 206, 208, 210 or 506, 508, 510. The resilient members 718, which may also be in the form of coil springs, may be referred to as reactor members, or reactor springs.

While the classifier 200, 500 (and in particular the sections 206, 208, 210 or 506, 508, 510) is illustrated as generally sloping downward from the inlet end 202, 502 to the outlet end 204, 504, this need not be the case according to all embodiments. It will be recognized that the classifier 200, 500 may instead have the inlet end 202, 502 and the outlet end 204, 504 at a common elevation relative to the horizontal, or the classifier 200, 500 may slope upward from inlet end 202, 502 to the outlet end 204, 504.

While the foregoing was discussed relative to a mixed solid waste stream of paper, glass containers, metal containers and plastic containers, it will be recognized that the usefulness of the foregoing sorting system is not limited to the materials discussed herein.

What is claimed is:

1. A system for sorting comprising:

an inlet end;

a first separation section disposed downstream of the inlet end and comprising a fluidizing section and a hood disposed above the fluidizing section, the hood connected to a air handling system to develop a negative pressure adjacent the fluidizing section to draw a first class of materials into the hood;

a second separation section disposed downstream of the first separation section and comprising an air knife and a dropout, a second class of materials passing through the air knife and into the dropout and a third class of materials passing over the dropout and through an outlet end; and a vibration generator coupled to the first separation section and the second separation section to convey material from the inlet end to the outlet end, wherein the air handling system comprises an expansion box to remove the first class of materials from an air stream passing through the expansion box, and a blower disposed downstream of the expansion box to draw air through the hood and the expansion box to generate the negative pressure adjacent the fluidizing section of the first separation section.

2. The system according to claim 1, further comprising a seal disposed between the first and second separation sections.

3. The system according to claim 1, wherein the fluidizing section of the first separation section comprises a first fluidizing deck, and the second separation section comprises a second fluidizing deck downstream of the first fluidizing deck and upstream of the air knife.

4. The system according to claim 1, wherein the fluidizing section of the first separation section comprises a fluidizing deck adjacent the air knife of the second separation section.

5. The system according to claim 1, further comprising:

a third separation section disposed downstream of the inlet end and upstream of the first separation section, the third separation section comprising a deck with a plurality of openings to permit a fourth class of material to pass through the openings and out a discharge chute.

6. The system according to claim 5, further comprising a first seal disposed between the first and second separation sections, and a second seal disposed between the first and third separation sections.

7. The system according to claim 5, wherein the fluidizing section of the first separation section comprises a first fluidizing deck, and the second separation section comprises a second fluidizing deck downstream of the first fluidizing deck and upstream of the air knife.

8. The system according to claim 5, wherein the fluidizing section of the first separation section comprises a fluidizing deck adjacent the air knife of the second separation section.

9. The system according to claim 1, wherein the air knife is an adjustable air knife defined by a fixed wall and a moveable deflector plate, and the deflector plate translates relative to the fixed wall between a first position and a second position without rotation.

10. The system according to claim 1, wherein the first class of materials comprises ultralights comprising paper, the second class of materials comprises heavies comprising glass and metal containers, and the third class of materials comprises lights comprising plastic containers.

* * * * *